US006830392B2

(12) United States Patent
Kobayashi et al.

(10) Patent No.: US 6,830,392 B2
(45) Date of Patent: Dec. 14, 2004

(54) PRINTING APPARATUS

(75) Inventors: Takehito Kobayashi, Yamanashi-ken (JP); Hajime Isono, Yamanashi-ken (JP); Wataru Tsuruta, Yamanashi (JP)

(73) Assignee: Nisca Corporation, Yamanashi-ken (JP)

( * ) Notice: Subject to any disclaimer, the term of this patent is extended or adjusted under 35 U.S.C. 154(b) by 0 days.

(21) Appl. No.: 10/728,882

(22) Filed: Dec. 8, 2003

(65) Prior Publication Data

US 2004/0081501 A1 Apr. 29, 2004

Related U.S. Application Data

(62) Division of application No. 10/158,200, filed on May 31, 2002, now Pat. No. 6,796,732.

(30) Foreign Application Priority Data

May 31, 2001 (JP) ..... 2001-165380
May 31, 2001 (JP) ..... 2001-165656
Jul. 26, 2001 (JP) ..... 2001-226704

(51) Int. Cl.[7] ..... B41J 2/315

(52) U.S. Cl. ..... 400/120.01; 400/188

(58) Field of Search ..... 400/120.01, 188

(56) References Cited

U.S. PATENT DOCUMENTS 5,558,449 A * 9/1996 Morgavi ..... 400/188

* cited by examiner

*Primary Examiner*—Charles H. Nolan, Jr.
(74) *Attorney, Agent, or Firm*—Manabu Kanesaka

(57) ABSTRACT

A printing apparatus has an image forming portion for forming an image on an intermediate transfer sheet for temporarily retaining the image and a transfer portion for transferring the image formed on the intermediate transfer medium to a card. An over-coating device is provided for covering a surface of the card with the image with a coating film. The image forming portion is also capable of printing an image directly on a card. A platen roller supports the card or the intermediate transfer medium. The apparatus can switch between the direct transfer method and the indirect transfer method, thereby reducing a size and a cost of the printing apparatus.

9 Claims, 8 Drawing Sheets

PRINTING APPARATUS

CROSS REFERENCE TO RELATED APPLICATION

This is a divisional application of a patent application Ser. No. 10/158,200 filed on May 31, 2002, now U.S. Pat. No. 6,797,732.

BACKGROUND OF THE INVENTION AND RELATED ART STATEMENT

The present invention relates to a printing apparatus for printing a variety of information such as images and characters to a recording medium, such as a card, and more particularly to a printing apparatus that is capable of switching printing methods according to the characteristics of the recording medium or the information that is to be recorded.

Conventionally, thermal transfer method printing apparatuses that record desired images and characters by thermally transferring with a thermal head via a thermal transfer film to a recording medium are used to create card shaped recording medium, like credit cards, cash cards, license cards and ID cards. As an example, Japanese Patent Publication (KOKAI) No. H9-131930 teaches a direct transfer method printing apparatus that directly transfers images and characters to a recording medium via thermal transfer film. The use of a thermal sublimate ink has the benefit of attaining high quality images because this type of ink is more expressive. However, a receptive layer to receive ink on the surface of a recording medium to which images, etc., are transferred is an essential element to enable this method of printing, so a problem exists in that either the type of recording medium that can be used is limited, or it is necessary to form the aforementioned receptive layer upon the surface of a recording medium.

Generally, cards made of polyvinyl chloride (also known as PVC cards) are widely used as the recording medium because they can receive thermal sublimate ink. However, due to the fact that harmful substances are generated when these cards are burned, there has been consideration given to switching to cards made of polyethylene terephthalate (also known as PET cards). However, PET cards have a crystal-like quality so not only is it difficult to use them for thermal sublimate printing, but embossing them is also difficult. Thus, if it is necessary to emboss the surface of the recording medium, the use of PVC cards is presently unavoidable.

Furthermore, in recent years there are card shaped media of the type having IC chips or antennae embedded therein such as IC cards, which are being used in a variety of fields. Because of the embedding of such elements into the card, the surface of the card becomes uneven resulting in problems in transferring images.

Japanese Patent Publication (KOKAI) No. H8-332742 teaches the technology of an indirect transfer method printing apparatus that transfers an image to an intermediate transfer medium once, then transfers that image again to the recording medium, as a method for overcoming the aforementioned problems. According to this method, it is possible to overcome the problems such as the limitation of recording medium related to the receptive layer or the transferring of images to an uneven surface of the recording medium which had been considered demerits of the direct transfer method. Furthermore, this method has the advantage of being easier to print to the entire surface of the card shaped recording medium compared to the direct transfer method.

Disclosed in Japanese Patent Publication (KOKAI) No. H8-58125 is a thermal transfer printing apparatus that prints to both the front and back surfaces of a recording paper, configured to transfer ink to an intermediate transfer film using a thermal head and after forming an image, to re-transfer the ink image to a recording paper surface by a heat roller, and configured to transfer ink to the back side of a recording paper with a thermal head that is different from the aforementioned thermal head.

However, running costs for the intermediate transfer method are higher than the direct transfer method because an intermediate transfer medium must be used. Printing also takes longer. Furthermore, depending on the design of the card, even if the entire front surface is required for printing, often times the back side only is used to print precautions for card use, thus there are fewer cases requiring printing over the entire surface, so there are merits and demerits for both methods of printing. Furthermore, according to the technology disclosed in Japanese Patent Publication (KOKAI) No. H8-58125, a plurality of thermal heads and ink films are disposed so the printing apparatus becomes very large in size thereby increasing associated costs. Still further, in the event that a coating film is used to protect the ink transferred to the back side of the recording paper in the transferred layer using the aforementioned different thermal head, or to prevent falsification, a separate apparatus such as an over-coating apparatus would be required, thereby increasing the overall size of the apparatus and its associated costs.

Therefore, to handle information relating to printing, such as the surface shape and characteristics of the recording medium including the type of material of the recording medium such as whether it is PVC or PET, embossed or whether or not it includes IC elements and whether or not it is necessary to print to the entire surface of the recording medium, a printing apparatus can switch printing methods between the direct transfer method and the indirect transfer method to enable printing with the method most appropriate to the recording medium, and to reduce running costs associated with printing. Furthermore, members required for printing in the direct transfer method and the indirect transfer method are intensively arranged and if part of the members can be unified, the overall size of the printing apparatus can be made more compact and a lower cost printing apparatus can be attained. Furthermore, an over-coating apparatus is built-in to cover the surface of recording medium thereupon directly printed by the printing apparatus and if the member is shared, it is possible to conserve space and to promote the reduction of cost so such printing apparatus could be widely used.

An object of the present invention is to provide a low cost printing apparatus that can switch between the direct transfer method and the indirect transfer method for printing and is not large in overall size.

Another object of the present invention is to provide a printing apparatus that can print to a recording medium with the most appropriate printing method and that reduces the running costs associated with printing.

Still another object of the present invention is to provide a printing apparatus can form high quality images with both the direct transfer method and the indirect transfer method.

SUMMARY OF THE INVENTION

In order to attain the aforementioned objectives, the print apparatus according to the present invention is equipped with a first printing means for forming images on a recording medium and a second printing means for forming images on an intermediate transfer medium that temporarily retains the image, a transfer means for transferring the image on the aforementioned intermediate transfer medium to the aforementioned recording medium, the aforementioned first printing means and the aforementioned second printing means arranged at the same position.

The aforementioned first printing means and the aforementioned second printing means are composed of the same printing elements. A platen is opposingly arranged to the aforementioned printing elements for supporting the aforementioned recording medium when forming images thereto by the aforementioned first printing means and for supporting the aforementioned intermediate transfer medium when forming images thereto by the aforementioned second printing means.

Further provided is a thermal energy control means for controlling the aforementioned printing elements to vary the thermal energy for printing images when forming images on a recording medium with the aforementioned first printing means and when forming images on a recording medium with the aforementioned second printing means. The aforementioned thermal energy control means controls so that the thermal energy applied when forming images on a recording medium using the aforementioned first printing means is greater than that applied when forming images on the intermediate transfer medium by the aforementioned second printing means.

The aforementioned transfer means can be a heat roller comprising a heating element.

Still further comprised are a recording medium transport means for transporting the aforementioned recording medium, a recording medium transport drive means for driving the aforementioned recording medium transport means, an intermediate transfer medium transport means for transporting the aforementioned intermediate transfer medium and an intermediate transfer medium transport drive means for driving the aforementioned intermediate transfer medium transport means, wherein the aforementioned recording medium transport drive means and the aforementioned intermediate transfer medium transport drive means are driven so that the transport direction of the aforementioned recording medium when forming images thereto by the aforementioned first printing means and the transport direction of the aforementioned intermediate transfer medium when forming images thereto by the aforementioned second printing means are the same.

Still further comprised are a recording medium transport means for transporting the aforementioned recording medium, a recording medium transport drive means for driving the aforementioned recording medium transport means, an intermediate transfer medium transport means for transporting the aforementioned intermediate transfer medium and an intermediate transfer medium transport drive means for driving the aforementioned intermediate transfer medium transport means, wherein the aforementioned recording medium transport drive means and the aforementioned intermediate transfer medium transport drive means are driven so that the transport speed of the aforementioned recording medium when forming images thereto by the aforementioned first printing means and the transport speed of the aforementioned intermediate transfer medium when forming images thereto by the aforementioned second printing means are the different. At this time, it is preferable that the transport speed of the intermediate transfer medium by the aforementioned intermediate transfer medium transport means is higher than the transport speed of the recording medium by the aforementioned recording medium transport means.

Still further comprised are the first thermal transfer sheet comprising a plurality of colored inks that apply to the aforementioned first printing means, and the second thermal transfer sheet comprising a plurality of colored inks that apply to the aforementioned second printing means, wherein the aforementioned first and the aforementioned second thermal transfer sheets are composed of the same sheet. The aforementioned first and second thermal transfer sheets are arranged with the layer region of a plurality of inks and either a layer region of a single adhesive or a protective layer region in order.

Also comprised are the thermal transfer sheet transport means for transporting the aforementioned first and second thermal transfer sheets, the aforementioned thermal transfer sheet transport means being driven so that the transport speed of the aforementioned first thermal transfer sheet when forming images to a recording medium by the aforementioned first printing means and the transport speed of the aforementioned second thermal transfer sheet when forming images to the aforementioned intermediate transfer medium by the aforementioned second printing means are different. At this time, the transport speed of the aforementioned second thermal transfer sheet when forming images to the aforementioned intermediate transfer medium by the aforementioned second printing means is preferred to be higher than the transport speed of the first thermal transfer sheet when forming images to the aforementioned recording medium by the aforementioned first printing means.

Also provided is a thermal energy control means for controlling the first and second printing means to form images by varying the thermal energy the aforementioned first printing means applies to the aforementioned first thermal transfer sheet when forming images to the aforementioned recording medium and the thermal energy the aforementioned second printing means applies to the aforementioned second thermal transfer sheet when forming images to the aforementioned recording medium. At this time, it is preferred that the aforementioned thermal energy control means controls so that the thermal energy applied to the first thermal transfer sheet by the aforementioned first printing means is greater than that applied to the aforementioned second thermal transfer sheet by the aforementioned second printing means.

The print apparatus according to the present invention is equipped with at least one printing means for selectively forming images to a recording medium and to an intermediate transfer medium that temporarily retains images, an over-coating means to cover the surface of the aforementioned recording medium formed thereupon with images with a coating film and a transfer means for transferring the image on the aforementioned intermediate transfer medium to the aforementioned recording medium, the aforementioned over-coating means and the aforementioned transfer means arranged at the same position.

The aforementioned over-coating means and the aforementioned transfer means arranged at the same position are composed of the same heating elements. The aforementioned heating elements can be a heat roller comprising exothermic body.

Here, further comprised are the supply spool shaft that is capable of mounting the first supply spool for supplying the aforementioned intermediate transfer medium and the second supply spool for supplying the aforementioned coating film and the take-up spool shaft that is capable of mounting the first take-up spool for taking up the aforementioned intermediate transfer medium and the second take-up spool for taking up the aforementioned coating film, at least one of the aforementioned supply spool shaft and the aforementioned take-up spool shaft is a single spool shaft.

A platen is opposingly arranged to the aforementioned heating elements and supports the aforementioned recording medium when covering by the aforementioned over-coating means and when transferring images by the aforementioned transfer means.

Further equipped is the first drive means that rotatingly drives the aforementioned take-up spool shaft, wherein this first drive means rotatingly drives the aforementioned first supply spool and/or the aforementioned second supply spool. At this time, it is preferred that the aforementioned first drive means is a reversible rotating drive motor.

The intermediate transfer medium transport means for transporting the aforementioned intermediate transfer medium is equipped in the intermediate transfer medium transport path between the aforementioned first supply spool and the aforementioned first take-up spool and further equipped is the second drive means for rotatingly driving the aforementioned intermediate transfer medium transport means. At this time, the second drive means is a reversible drive motor, and further equipped with a measuring means for measuring the feeding and returning amount of the aforementioned intermediate transfer medium disposed in the aforementioned intermediate transfer medium transport path.

Other objectives and features of the present invention shall be clearly explained in a detailed description of the preferred embodiment below based upon the drawings provided.

BRIEF DESCRIPTION OF THE DRAWINGS

FIGS. 2A and 2B are side views showing the linked state of second turning portion and first turning portion in the printing apparatus according to the present invention, wherein FIG. 2A shows the vertical status of card reception, and FIG. 2B shows the vertical status after synchronized inversion;

FIGS. 7A to 7C are explanatory drawings of the thermal transfer sheet and intermediate transfer sheet, wherein FIG. 7A and FIG. 7C are front views showing a model of the thermal transfer sheet, and FIG. 7B is a sectional view showing a model of the intermediate transfer sheet.

DETAILED DESCRIPTION OF THE PREFERRED EMBODIMENTS

The following shall explain the preferred embodiment of the present invention to enable printing with a direct transfer method and indirect transfer method, in reference to the drawings provided.

Figure 1:
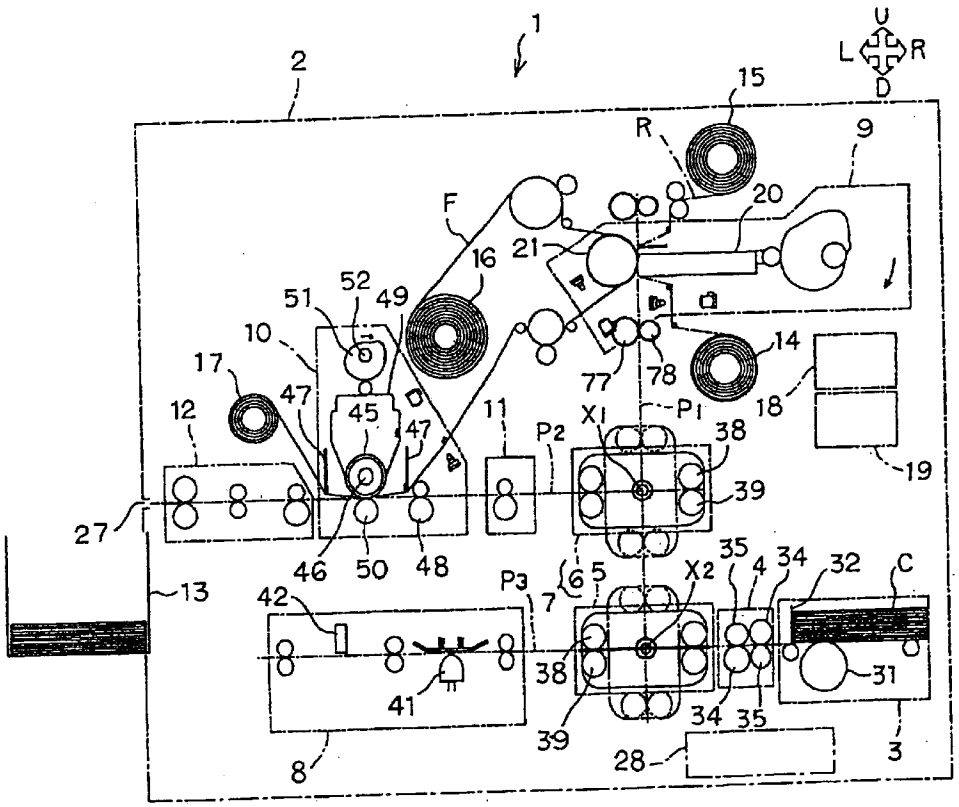
FIG. 1 is a side view showing the general configuration of the printing apparatus according to the embodiment of the present invention.

As can be clearly seen in FIG. 1, the printing apparatus 1 according to the embodiment of the present invention comprises in the housing of the frame 2, the third card transport path P3 which is the card transport path for recording information to the card C as the recording medium, the first card transport path P1 which is the card transport path for forming (printing) images to the card C using the direct transfer method, and the second card transport path P2 which is the card transport path for transferring to the card C images temporarily held on the intermediate transfer sheet F as the intermediate transfer medium using the indirect transfer method. The second card transport path P2 and the third card transport path P3 are disposed substantially horizontally, the first card transport path P1 disposed substantially vertically. The second card transport path P2 is disposed substantially parallel to the aforementioned third card transport path P3 thereabove, the second card transport path P2, the third card transport path P3 and the first card transport path P1 each intersecting substantially orthangonally at intersecting points X1 and X2. Note that the intermediate transfer sheet F, described below, is arranged facing the first card transport path P1 and the thermal transfer sheet R, also described below, is arranged on the other side.

To the third card transport path P3 are arranged the card supply portion 3 that separates blank card C (those that have yet to be magnetically recorded or printed thereto) into single cards and sends them to the third card transport path P3, the cleaner 4 that cleans the surface of the blank card C downstream of the card supply portion 3, the second turning portion 5 that rotates or inverts the card C while nipped, rotating around the intersecting point of X2 downstream of the cleaner 4, and orthangonally switches the card C transport path to the first card transport path P1 direction, and downstream of the aforementioned second turning portion 5 the information recording portion 8 to write data or read data on a magnetic strip formed on the card surface (back surface) such as those found in credit cards.

The card supply portion 3 comprises the card stacker to store stacks of a plurality of the blank cards C. The stacker side plate 32 that comprises an opening slot to allow only one of card C to pass therethrough is arranged in the position facing the third card transport path P on the card stacker. To the bottom of the card stacker is pressingly arranged the kick roller 31 that rotatingly feeds the bottom most blank card C of a plurality of the blank cards C stored in a stack in the card stacker to the third card transport path P3.

The cleaner 4 comprises the cleaning roller 34, made of a rubber material, the surface thereof applied with an adhesive substance and the pressing roller 35 to press facing each other nipping the third card transport path P3.

The information recording portion 8 comprises the information reading and writing head 41 of a magnetic encoder, etc. for magnetically recording information to the aforementioned magnetic strip while taking magnetic information that has been recorded for verification (to compare magnetic information that should be recorded and recorded magnetic information), an IC contact point 42 for accessing the data electrically recorded to the IC card and a plurality of paired rollers capable of forward and reverse rotation to receive the blank cards C from the second turning portion 5, and while transporting them toward the direction of arrow L in FIG. 1 toward the information writing and reading head 41 when magnetically writing and reading information to the magnetic strip and to the IC contact point 42 to access data that was electrically recorded to the IC card and to send the recorded cards C in the direction of the arrow R in FIG. 1 after recording thereto by the information writing and reading head 41 and/or by the IC contact point 42 to the second turning portion 5.

Figure 2A:
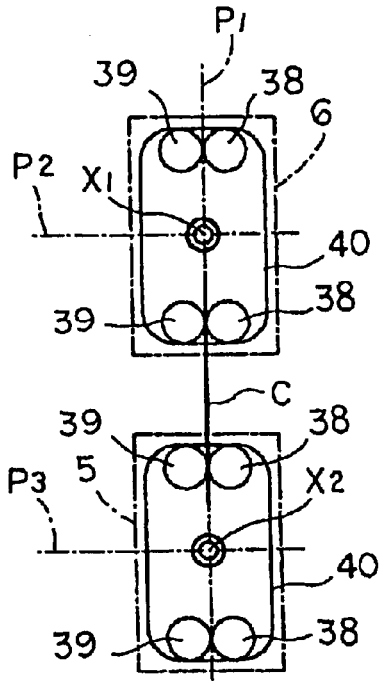
Figure 2B:
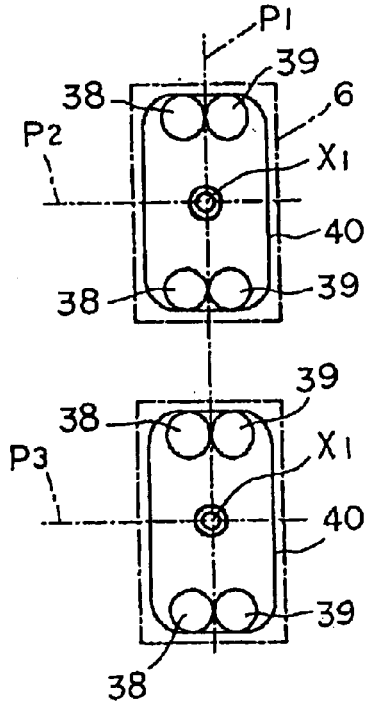

On the first card transport path P1 is arranged the first inverting portion 6 to rotate or invert the rotation centering on the intersecting point X1 while nipping the card C to selectively switch transport paths to either the first card transport path P1 and the second card transport path P2. As can be seen in FIG. 1, FIG. 2A, and FIG. 2B, the second turning portion 5 arranged on the intersection point X2 and the first turning portion 6 arranged on the intersecting point X1 comprise identical structures and are structured to rotate or invert in synchronization by a drive portion which is not shown in the drawings.

The second turning portion 5 and the first turning portion 6 comprise the paired pinch rollers 38 and 39 that are capable of nipping the card C which has completed the magnetic recording process, and comprise the rotating frame 40 that rotatingly supports these pinch rollers to rotate or invert centering around the intersecting points of X1 and X2. One of the pinch rollers 38, 39 is a driving roller, and the other follows the drive of that roller. The pinch rollers 38 and 39 press together sandwiching the third card transport path P3 (for the second turning portion 5) or the second card transport path P2 (for the first turning portion 6) when the rotating frame 40 is in a horizontal state, as clearly shown by the solid line in FIG. 1, and press together sandwiching the first card transport path P1 when the rotating frame 40 is in a vertical state, as clearly shown in FIG. 2A (and the dotted lines in FIG. 1). Note that before and after the second turning portion 5 on the third card transport path P3 and between the second turning portion 5 and first turning portion 6 on the first card transport path P1, and between the image forming portion 9, described below, and the first card transport path P1, and still further, between the first turning portion 6 and the paired horizontal transport rollers 11, described below, on the second card transport path P2 are arranged the unitized transmissive sensors, not shown in the drawings, to detect the presence of the card C therebetween.

When the rotating frame 40 is rotated or inverted while nipping a card between the pinch rollers 38 and 39, the pinch rollers 38 and 39 rotate together to displace the card C so the rotating or turning action at the second turning portion 5 and the first turning portion 6 is driven independently to the rotation or inversion of the rotating frame 40 and the rotation of the pinch rollers 38 and 39. A unitized transmissive sensor (combined with a slit plate), omitted from the drawings, to detect the angle of rotation of the rotating frame 40 is disposed and to judge the direction of rotation of the pinch rollers 38 and 39 a unitized transmissive sensor. (combined with a semi-circular plate), also not shown in the drawings, is disposed to detect the position of either of one of the pinch rollers 38 and 39 so it is possible to freely set the rotating angle of the rotating frame 40 and to control the transport direction of the card C by the pinch rollers 38 and 39.

Figure 3:
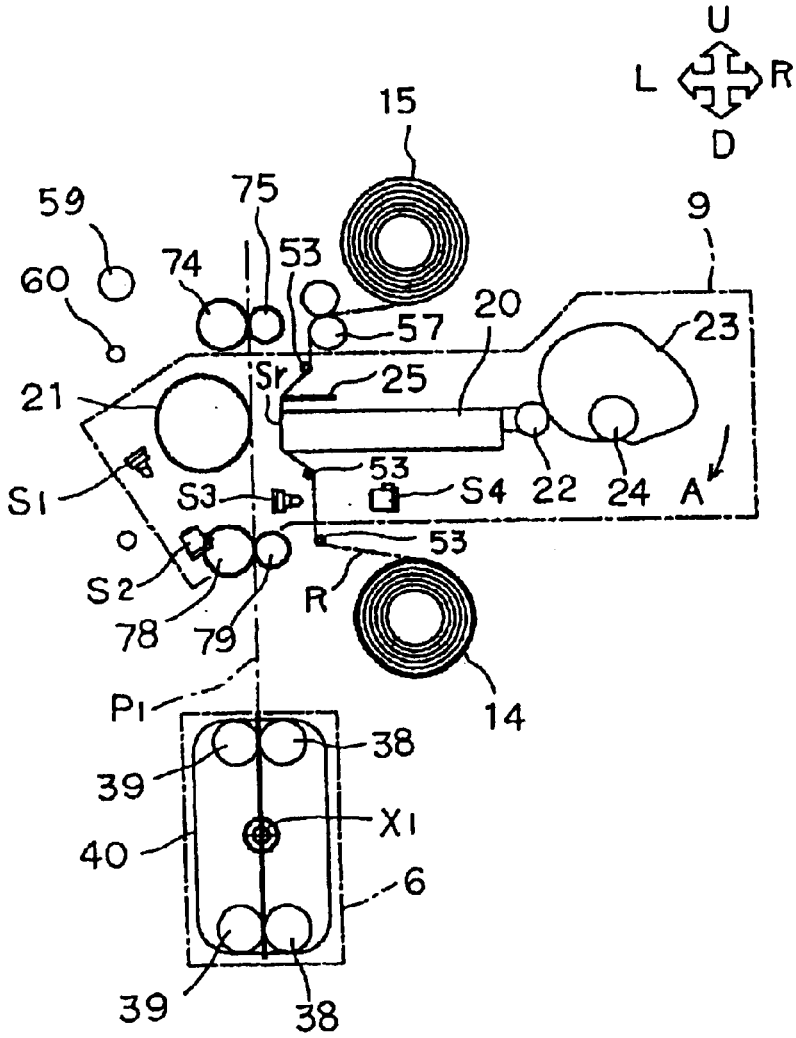
FIG. 3 is a side view near the image forming portion when employing direct printing or hologram processing using the printing apparatus according to the embodiment of the present invention.

As shown in FIG. 3, the image forming portion 9 for forming images to the intermediate transfer sheet, which is described below, or the card C using the thermal transfer ink according to the image or character image information is arranged downstream of the first turning portion 6 (the direction of arrow U in FIG. 3) on the first card transport path P1. The image forming portion 9 employs the configuration of a thermal transfer printer and comprises the platen roller 21 that supports the card C when printing to a surface thereof and the thermal head 20 retractably arranged to the platen roller 21. The thermal transfer sheet R is interposed between the platen roller 21 and thermal head 20.

The retracting movement of the thermal head 20 to and from the platen roller 21 is performed by the thermal head sliding drive unit that comprises the holder, not shown in the drawings, that removably supports the thermal head 20, the follower roller 22 that is fastened to the holder, the non-circular thermal head sliding cam 23 that rotates in either direction (the direction of arrow A or the opposite in the drawing) around the cam shaft 24 while following the outer contour of the follower roller 22 and the spring, not shown in the drawings, to press the holder against the thermal head sliding cam 23.

Figure 7A:
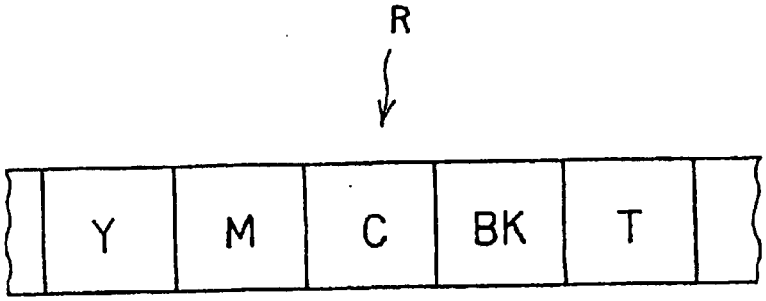
Figure 7B:
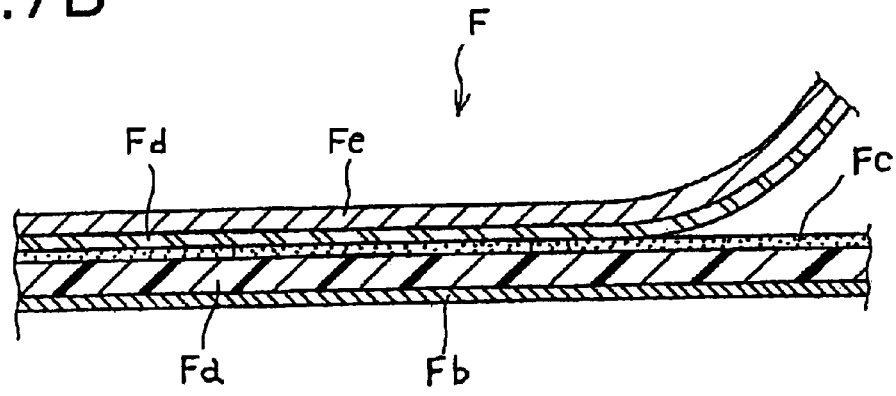
Figure 7C:
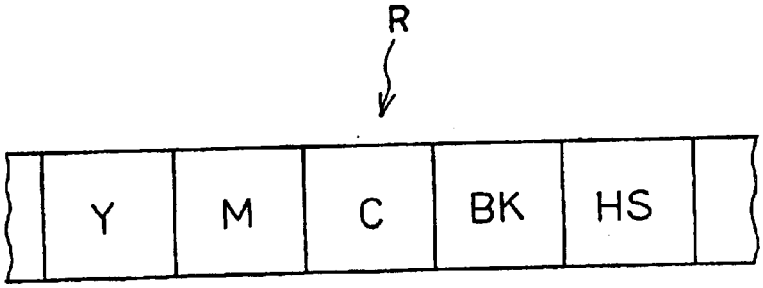

As shown in FIGS. 7A to 7C, the thermal transfer sheet R is affixed with the inks of Y (yellow), M (magenta), C (cyan) and Bk (black) in order on the film having widths slightly larger than the length of the card C in the length direction, and comprises a protective layer region T to protect the card C surface formed thereupon by images, after the Bk (black) and in repeated bands in order along the surface. As shown in FIGS. 7A to 7C, the thermal transfer sheet R is affixed with the inks of Y (yellow), M (magenta), C (cyan) and Bk (black) in order on the film having widths slightly larger than the length of the card C in the length direction. It is acceptable to arrange an adhesive layer Hs in order repeatedly after the Bk (black) region to adhere the image to the surface of the card C, but the adhesive layer Hs is particularly applicable for cards having a material difficult to receive inks, such as a polycarbonate type card. Note that the adhesive layer Hs is arranged after the Bk (black) ink region, in FIG. 7C, but it is also perfectly acceptable to configure that adhesive layer after C (cyan) which is before Bk (black), or in other words between each C (cyan) and Bk (black) ink layer region.

FIG. 3 shows the thermal transfer sheet R supplied from the thermal transfer sheet supply portion 14 where the thermal transfer sheet R is wound in a roll, guided by a plurality of guide rollers 53 and the guide plate 25 which is fastened to the holder, not shown in the drawings, while substantially touching the entire surface of the leading edge of the thermal head 20, driven along with the rotational-drive of the paired take-up roller 57, to be rolled onto the thermal transfer sheet take-up portion 15. The thermal transfer sheet supply portion 14 and the thermal transfer sheet take-up portion 15 are arranged in positions on both sides of the thermal head 20, the centers thereof mounted onto the spool shaft. To the image forming portion 9, the mark for positioning of the thermal transfer sheet R and the light emitting elements S3 and light receiving elements S4 for detecting the position of the Bk portion on the thermal transfer sheet R are arranged separated from but perpendicular to the thermal transfer sheet R between the two guide rollers 53 arranged between the thermal transfer sheet supply portion 14 and the thermal head 20.

Note that to the drive side roller shaft of the paired take-up rollers 57 is mated a gear, not shown in the drawings, the gear meshing with the gear comprising the clock plate not shown in the drawings on the same shaft. Near the clock plate (not shown) is arranged the unitized transmissive sensor, which also is not shown, to detect the rotation of the clock plate to control the amount of take-up of the thermal transfer sheet R.

Figure 5:
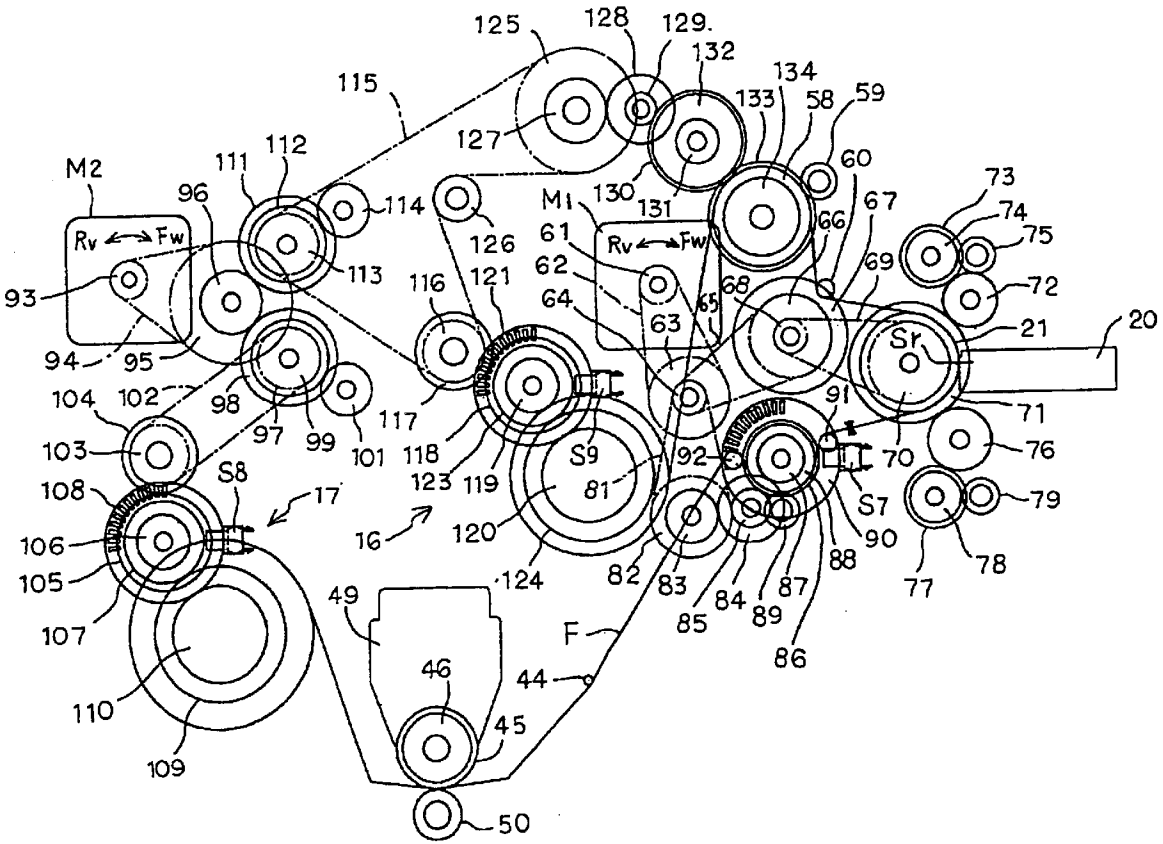
FIG. 5 is a side view showing the card transport mechanism near the intermediate transfer sheet transport mechanism and image forming portion of the printing apparatus according to an embodiment of the present invention.

The printing position (heating position) Sr of the thermal head 20 interposed by thermal transfer sheet R toward the card C corresponds to the first card transport path P1 on the outer circumference of the platen roller 21 (see also FIG. 5). On both sides of the image forming portion 9 are arranged the capstan roller 74 comprising a constant rotating speed, the pinch roller 75 pressing thereto the capstan roller 74 and paired rollers configured by the capstan roller 78 and pinch roller 79 nipping the first card transport path P1 that rotate in synchronization to the moving of the card C in the directions of the arrow U and the arrow D in FIG. 3 with regard to the printing position Sr.

Figure 4:
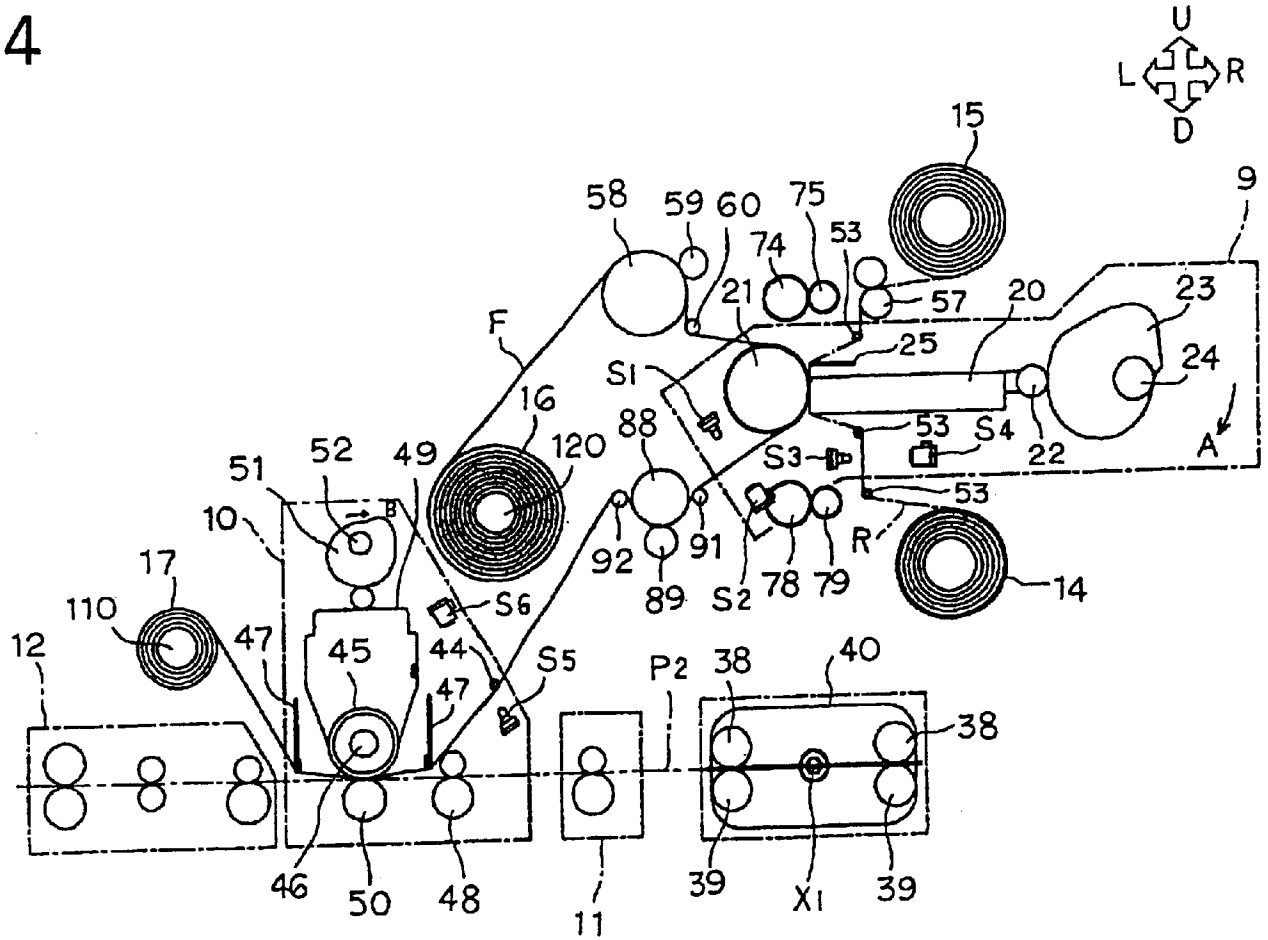
FIG. 4 is a side view of the printing apparatus according to the embodiment to perform direct printing and indirect printing.

As shown in FIG. 1 and FIG. 4, when forming an image on the card C using the direct transfer method, the intermediate transfer sheet F is fed to around the platen roller 21. As shown in FIG. 7B, the intermediate transfer sheet F is formed of the base film Fa, the back surface coating layer Fb formed on the back side of the base film Fa, the receptive layer Fe to receive ink, the overcoat layer Fd to protect the receptive layer Fe surface, and the peeling surface Fc to promote the peeling of the overcoat layer Fd and the receptive layer Fe thermally joined, from the base film Fa, wherein the back surface coating layer Fb, the base film Fa, the peeling surface Fc, the overcoat layer Fd and the receptive layer Fe are formed in order in layers from the bottom. The intermediate transfer sheet F is trained with the receptive layer Fe opposing the thermal transfer sheet R and the back coating layer Fb side touching the platen roller 21. Note that to the image forming portion 9, the light emitting element Si and the light receiving element S2 for detecting the mark for positioning of the intermediate transfer sheet F are arranged separated from but perpendicular to the intermediate transfer sheet F between the platen roller 21 and guide roller 91. This can be seen in FIG. 3 and FIG. 4.

On the second card transport path P2, downstream of the first turning portion 6 are disposed the paired horizontal transport rollers 11 to transport the card C in the horizontal direction, the transfer portion 10 to transfer images formed on the intermediate transfer sheet F at the image forming portion 9 and the horizontal transport portion 12 comprising the discharge rollers to discharge the card C to outside of the frame 2 while transporting the card C to the side of the arrow L in FIG. 4, comprising a plurality of transport rollers.

The transfer portion 10 comprises the platen roller 50 that supports the card C when transferring from the intermediate transfer sheet F to the card C or the hologram sheet H, described below, and the heat roller 45 slidably arranged to the platen roller 50. Built-in to the heat roller 45 is the heating lamp 46 as the heating body to heat the intermediate transfer sheet F or the hologram sheet H. The intermediate transfer sheet F or the hologram sheet H is interposed between the platen roller 50 and heat roller 45.

The retracting movement of the heat roller 45 with regard to the platen roller 50 is performed by the elevator drive unit comprising the holder 49 that removably supports the heat roller 45 built into the holder 49, the follower roller 43 that is fastened to the holder 49, the non-circular heat roller elevator cam 51 that rotates in one direction (the direction of arrow B in FIG. 4) centering around the cam shaft 52 while following the outer contour of the follower roller 43 and the spring, not shown in the drawings, that presses the upper surface of the holder 49 against the heat roller elevator cam 51.

The intermediate transfer sheet F is supplied from the intermediate transfer sheet supply portion 16 the intermediate transfer sheet F wrapped thereabout, and is guided by the transport roller 58 that accompanies the follower roller 59, the guide roller 60 and platen roller 21, the guide roller 91, the back tension roller 88 that applies a reverse tension to the intermediate transfer sheet F along with the pinch roller 89, the guide rollers 92 and 44 and the guide plate 47 mounted to the frame configuring the transfer portion 10 arranged on both sides of the heat roller 45. When transferring, the card C is sandwiched between the platen roller 50 and heat roller 45 on the second card transport path P2 and the intermediate transfer sheet F is taken up by the intermediate transfer sheet take-up portion 17 that takes up the intermediate transfer sheet F. Furthermore, to the transfer portion 10 the paired transport rollers 48 transportable in the direction of the arrow L in FIG. 4 pressing together to sandwich the second card transport path P2 to transport the card C on the second card transport path P2 is arranged downstream of the paired horizontal transport rollers 11 and upstream of the platen roller 50. Furthermore, to the image forming portion 10, the light emitting element S5 and light receiving element S6 for detecting the mark for positioning of the intermediate transfer sheet F are arranged on either side of the intermediate transfer sheet F between the guide roller 44 and guide plate 47.

As can be seen in FIG. 5, within the region of the frame 2, the first card transport path P1 and the second card transport path P2 shown in FIG. 1, the drive mechanism that gets its driving force from the reversible pulse motors M1 and M2 as the source of drive movement, is arranged. The timing pulley 61 (hereinafter referred to as simply the pulley) is mated to the motor shaft on the pulse motor Ml and an endless timing belt 62 (hereinafter referred to as simply the belt) is trained between the pulley and the pulley 63. To the pulley 63 is mated the pulley 64 having a diameter smaller than the pulley 63.

To the pulley 64, the belt 65 is trained therebetween with the pulley 66. To the pulley 66 shaft is mated the solenoid clutch 67. The solenoid clutch 67 interlocks the rotational drive of the pulley 66 to the pulley 68 mated to the solenoid clutch 67 shaft only when directly printing with the thermal head 20 and when transporting the card C when directly printing. The pulley 70 is mated to the same shaft as platen roller 21 and the belt 69 is trained between the pulley 68 and the pulley 70. Furthermore, to the platen roller 21 shaft is mated the gear 71 having a diameter greater than the platen roller 21. To the gear 71 is meshed the gears 72 and 76. The gear 72 meshes with the gear 73 comprising on the same shaft the capstan roller 74 that presses against the pinch roller 75 and the gear 76 meshes with the gear 77 comprising on the same shaft the capstan roller 78 that presses against pinch roller 79.

Also, another belt, the belt 81, is trained to the pulley 64, transmitting rotational drive force to the pulley 82. To the pulley 82 shaft is mated the gear 83 that meshes with the gear 84. To the gear 84 shaft, the gear 85 having a diameter smaller than the gear 84, is mated, the gear 85 and the gear 86 meshing. The torque limiter 87 is mated to the shaft of the gear 86, rotational drive force is transmitted to the back-tension roller 88 via the torque limiter 87. The pinch roller 89 is pressed against the back-tension roller 88. To the same shaft as the back-tension roller 88 is mated the clock plate 90. As described below, while the intermediate transfer sheet F is being fed forward and in reverse, the back-tension roller 88 rotates in synchronization with the intermediate transfer sheet F. Near the clock plate 90 is arranged the unitized transmissive sensor S7 that detects the rotation amount of the clock plate 90 to control the amount of feeding of the intermediate transfer sheet F.

To the motor shaft of the pulse motor M2 is mated the pulley 93. The belt 94 is trained between the pulley 93 and the pulley 95. The gear 96 is mounted to the pulley 95 shaft.

In the counterclockwise direction, the drive from the gear 96 is transmitted and in the clockwise direction meshes with the one-way gear 97 mated to the shaft that is the pulley (freely rotates). To the shaft on the one-way gear 97, the gear 98 and pulley 99 are mated, and the gear 98 meshes in the clockwise direction with the one-way gear 101 that is a pulley and locked in the counterclockwise direction. To the pulley 99 the belt 102 is trained therebetween with the pulley 103. To the gear 103 shaft, the gear 104 is mated, and the gear 104 meshes with the gear 105. To the gear 105 shaft is mated the torque limiter transmitting rotational drive force to the gear 107 via the torque limiter 106. To the same shaft as the gear 107 is mated the clock plate 108. The gear 107 meshes with the gear 109 that is mated to the take-up spool shaft 110 to take up the intermediate transfer sheet F. Near the clock plate 108 is disposed the unitized transmissive sensor S8 to detect the amount of rotation of the take-up spool shaft 110, via the rotation of the clock plate 108, and to detect the take-up of the intermediate transfer sheet F by detecting the rotation of the take-up spool shaft 110.

Also, the gear 96 meshes with the one-way gear 111 mated to the shaft that is the pulley in the counterclockwise direction, the drive from the gear 96 being transmitted in the clockwise direction. To the shaft on the one-way gear 111, the gear 112 and pulley 113 are mated, and the gear 112 meshes in the clockwise direction with the one-way gear 114 that is the pulley and locked in the counterclockwise direction. To the pulley 113 the belt 115 is trained therebetween the pulley 116 and the pulley 125. Note that to maintain a constant tension on the belt 115, the tension roller 126 is disposed between the pulley 116 and the pulley 125 which are connected by the belt 115. To the gear 116 shaft, the gear 117 is mated, and the gear 117 meshes with the gear 118. To the gear 118 shaft is mated the torque limiter transmitting rotational drive force to the gear 123 via the torque limiter 119. To the same shaft as the gear 123 is mated the clock plate 121. The gear 123 meshes with the gear 124 that is mated to the supply spool shaft 120 to supply the intermediate transfer sheet F. Near the clock plate 121 is disposed the unitized transmissive sensor S9 to detect the amount of rotation of the supply spool shaft 120, via the rotation of the clock plate 121, thereby detecting the feed of the intermediate transfer sheet F. Note that the intermediate transfer sheet supply portion 16 or the hologram sheet supply portion 29 is mounted to the supply spool shaft 120, the sheet take-up portion 17 or the hologram sheet supply portion 29 being mounted to the take-up spool shaft 110.

On the other hand, the drive from the pulley 113 is transmitted also to the pulley 125, via the belt 115. To the gear 125 shaft, the gear 127 is mated, and the gear 127 meshes with the gear 128. Still further, the drive is transmitted to the gear 130 via the gear 129 disposed on the same shaft as the gear 128. To the pulley 130 shaft is mated the solenoid clutch 131. The solenoid clutch 131 interlocks the rotational drive force of the gear 130 to the gear 133 via the gear 132 which is mated to the solenoid clutch 131 shaft only when taking up (Rv) the intermediate transfer sheet F to form images on the intermediate transfer sheet F by the thermal head 20. To the gear 133 shaft is mated the torque limiter 134 therethrough transmitting rotational drive force to the transport roller 58 to transport the intermediate transfer sheet F. Note that the speed of transporting of the intermediate transfer sheet F by the supply spool shaft 120, the platen roller 21 and the transport roller 58 when the aforementioned solenoid clutch 131 drive is interlocked, is set so that the speed of the supply spool shaft 120 is greater than the transport roller 58 which is greater than the platen roller 21. Regarding torque control, it is set so that the platen roller 21 is greater than the transport roller 58 which is greater than the supply spool shaft 120.

The feeding (Fw) and reverse (Rv) of the intermediate transfer sheet F is primarily performed by switching the direction of rotation of the pulse motor M2. When forming images on the intermediate transfer sheet F while undergoing the take-up return (Rv), the transport speed for the intermediate transfer sheet F by the supply spool shaft 20, the platen roller 21 and the back-tension roller 88 are set so that the supply spool shaft 20 is greater than the platen roller 21 which is greater than the back-tension roller 88. For that reason, as described below, when separating the thermal head 20 and feeding the intermediate transfer sheet F, drive is cut by the solenoid clutch 67 to prevent slackening of the intermediate transfer sheet F. Note that the transfer direction of the intermediate transfer sheet F at this time is in the feed direction from the supply spool shaft 120 to the back-tension roller 88.

Figure 6:
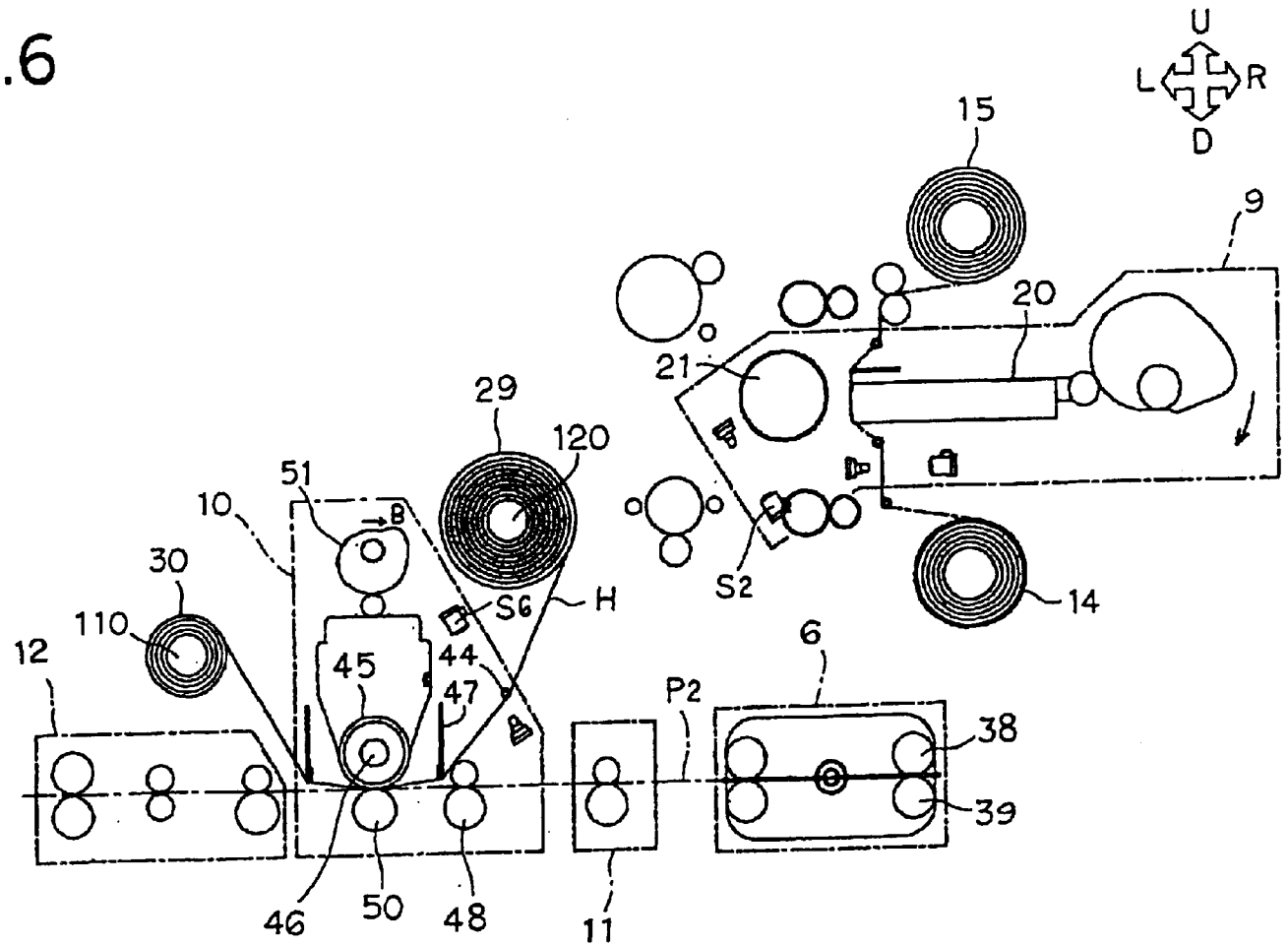
FIG. 6 is a side view of the printing apparatus according to the embodiment to perform hologram processing.

As shown in FIG. 6, the printing apparatus 1 according to the present embodiment can be manually mounted with the hologram sheet H instead of the intermediate transfer sheet F. In that case, the intermediate transfer sheet supply portion 16 and the intermediate transfer sheet take-up portion 17 are removed from the supply spool shaft 120 and the take-up spool shaft 110 in rolls, and the rolls of the hologram sheet supply portion 29 and the hologram sheet take-up portion 30 are mounted to the supply spool shaft 120 and the take-up spool shaft 110 in rolls and the hologram sheet H is trained to the appropriate positions. The hologram sheet H comprises the same structure of layers as the intermediate transfer sheet F shown in FIG. 7B. However, one point of difference is that it has a preformed hologram layer instead of the reception layer.

As can be seen in FIG. 1, formed on the line extended to the direction of arrow L on the second card transport path P2 in the frame 2 is the discharge roller 27 to discharge the card C whose printing has been completed, to outside of the frame 2. Below the discharge outlet 27 is removably mounted from the frame 2 the stacker for stocking a stack of the card C. Note that between the horizontal transport portion 12 and the discharge roller 27 is arranged the unitized transmissive sensor, not shown in the drawings. Furthermore, the eject outlet 28 is formed to eject the card C which has been determined to have had erroneous writing of data at the information recording portion 8 or the card C where errors were generated at the image forming portion 9 or the transfer portion 10, by rotating the second turning portion 5 to an oblique direction which is an intermediate position between the arrow D and the arrow R shown in FIG. 1 and to eject the aforementioned defective card C in the downward direction of the aforementioned oblique direction. To the eject outlet 28, it is also perfectly acceptable to mount a defective card receptacle to temporarily hold such defective cards.

Also, the printing apparatus 1 comprises in the frame 2 the power supply unit 18 that converts from the commercial alternating current to a drivable/operable direct current to drive all the mechanical and control portions and the control portion 19 to control operations of the entire printing apparatus 1. Furthermore, the printing apparatus 1 comprises a touch panel, not shown in the drawings, for operator to use to input operating instructions to the control portion 19 along with displaying the status of the printing apparatus 1 according to information from the control portion on the upper part of the frame 2.

The control portion 19 is equipped with a CPU block to control the processes of the printing apparatus 1. The CPU block is composed of a CPU that operates under a fast clock speed as its central processing unit, a ROM written with control instructions for the printing apparatus 1 and an internal bus to connect with the RAM that works using the work area on the CPU and these together.

To the CPU block is connected an external bus. To the external bus are connected the touch panel display operation control unit that controls the touch panel display and the operating instructions, the sensor control unit that controls the signals coming from the various sensors, the actuator control unit that controls the motor driver that outputs drive pulses to each motor and the solenoid clutch, the thermal head control unit that controls the thermal energy of the thermal head 20, the I/O interface therethrough the external computer and printing apparatus 1 communicate and the RAM for storing image information that is to be printed to the card C. The touch panel display and operation control unit, the sensor control unit, the actuator control unit and the thermal head control unit are each connected to the touch panel, the sensors including the sensors S1 to S9, the motor M1, the motor driver including the motor driver of M2 and the solenoid clutch 67 and to the thermal head 20.

The following shall describe the actions of the printing apparatus 1 according to this embodiment. In an effort to simplify the description, image information received from the external computer via the external I/O interface is stored in the RAM and printing information such as whether to use either or both the direct transfer method or indirect transfer method to the card C and whether to transfer to one side or to both sides of the card C, which image information, for direct transfers, whether or not the hologram sheet H is used for over-coating, recording information to write to the magnetic stripe or IC chip, or information relating to recording and printing such as the card C dimensions are already input via the touch panel or the external computer. The following describes two examples. The example (1) describes the operator operating the printing apparatus 1 to print to both sides of the card C using the direct transfer method and applying a hologram only to the front surface side (the side not formed thereupon with a magnetic strip). The example (2) describes the operator operating the printing apparatus 1 to print to the back side of the card C using the direct transfer method and printing to the front side using the indirect transfer method.

(1) Both side direct transfer (hologram processing on the front surface) operations.

First, when the CPU in the control unit 19 (hereinafter simply referred to as CPU) initializes, it takes up an amount of the intermediate transfer sheet F or the hologram sheet H for more than one image and if the light reception sensor S2 detects the ribbon position detection mark in that take-up operation, it determines that the intermediate transfer sheet F has been mounted. If the light emitting sensor S2 does not detect the ribbon position detection mark, it determines that the hologram sheet H has been mounted. Also, the spool shaft 110 and the spool shaft 120 are separated from any drive by the action of the clutch, not shown in the drawings, when either is taking up the sheet, so by monitoring sensor S8 or S9, it is possible to detect if the intermediate transfer sheet F or the hologram sheet H is not mounted or if it is broken. After this determination, the amount taken up for more one image is returned to complete the ribbon identification process.

In the state illustrated by FIG. 4, a detection signal from the light reception sensor S6 detects that either the intermediate transfer sheet F or the hologram sheet H exists (either sheet type is mounted and it is detected that the sheet has not been broken) and the detection signal from the light emitting sensor S2 detects that the intermediate transfer sheet F exists and that processing for a hologram is not possible. When it is determined that processing is not possible, the touch panel switches hologram sheet H to display the intermediate transfer sheet F and idles until the opening and closing door is opened and closed once. It determines again after the opening and closing door is opened and closed again. If the light emitting sensor S6 can determine the existence of neither the intermediate transfer sheet F nor the hologram sheet H, the touch panel displays that either the intermediate transfer sheet F or the hologram sheet H has either not been mounted or it has been broken and the printing apparatus idles until the opening and closing door is opened and closed once. After opening and closing once, it detects the existence of the intermediate transfer sheet F or the hologram sheet H. In the state illustrated by FIG. 6, a detection signal from the light emitting sensor S6 detects that either the intermediate transfer sheet F or the hologram sheet H exists. The light emitting sensor S6 detects that it is not the intermediate transfer sheet F (and that it is the hologram sheet H) so it is determined that hologram processing is possible.

When processing using the hologram is possible, the card supply portion 3 on arranged on the third card transport path P3, the cleaner 4 and the second turning portion 5 are operated. This transports the blank card C on the card supply portion 3 in the direction of arrow L in FIG. 1. In other words, by rotating the kick roller 31 on the card supply portion 3, the lowermost blank card C on the card stacker is sent to the third card transport path P3. Both sides of the blank card C are cleaned by the cleaning roller 34 on the cleaner 4. The leading edge of the blank card C is detected by the unitized transmassive sensor, not shown in the drawings, arranged between the second turning portion 5 and the cleaner 4 which stops the rotation of the kick roller 31 on the card supply portion 3. The blank card C is stopped after being sent for a determined number of pulses, from the aforementioned unitized sensor to the second turning portion 5 and the second turning portion 5 in a horizontal state nips the blank card C. (See FIG. 1)

Continuing on, recording information is sent to the information recording portion 8 and the blank card C is received between the second turning portion 5 and the information recording portion 8. The information recording portion 8 starts the rotational drive of the plurality of transport rollers in the direction to transport in the blank card C according to the instructions from the CPU. The CPU stops the rotation of the pinch rollers 38 and 39 on the second turning portion 5 that sent the card C to the information recording portion 8, according to the signals from the unitized transmissive sensor, not shown in the drawings, arranged between the second turning portion 5 and the information recording portion 8. The information recording portion 8 writes to the blank card C magnetic data and/or IC data using according to the recording information sent from the control portion 19. The CPU receives the information to verify whether the writing was successful or not from the information recording portion 8 and rotatingly drives the pinch rollers 36 and 39 on the second turning portion 5 in the direction of card C reception and issues the card C discharge instruction to the information recording portion 8. The CPU stops the rotation of the pinch rollers 38 and 39 on the second turning portion 5 according to the signals from the unitized transmissive sensor, not shown in the drawings, arranged between the second turning portion 5 and the information recording portion 8. The blank card C is stopped after being sent for a determined number of pulses, from the aforementioned unitized sensor to the second turning portion 5 and the second turning portion 5 in a horizontal state nips the blank card C. (See FIG. 1) When a writing error has occurred for the verify information received from the information recording portion 8, the second turning portion 5 rotates to an oblique direction which is the intermediate position between the arrows D and R in FIG. 1. The pinch rollers 38 and 39 rotatingly drive the erroneous card C toward the eject outlet 28 disposed downward in the aforementioned oblique direction.

When the verify information from the information recording portion 8 was written correctly (in other words, when there are no writing errors), the CPU rotates the second turning portion 5 90° (along with the first turning portion 6). (See FIG. 2A.) Continuing on, the pinch rollers 38 and 39 on the second turning portion 5 are rotatingly driven to send the card C in the direction of the arrow U in FIG. 1 and the pinch rollers 38 and 39 on the first turning portion 6 are rotatingly driven in the same way. This receives the card C between the second turning portion 5 and the first turning portion 6. (The state is shown in FIG. 2A.) The CPU stops the rotation of the pinch rollers 38 and 39 on the first turning portion 6 and the second turning portion 5 after the card C is detected by the unitized transmissive sensor, not shown in the drawings, arranged between the second turning portion 5 and the information recording portion 1 after sending the card for a determined number of pulses. While the card C is nipped in the first turning portion 6 (as shown in FIG. 3), the CPU starts the rotational drive of the pulse motor Ml to the motor driver of the pulse motor Ml while interlocking the solenoid clutch 67. This starts the rotational drive of the platen roller 21, the capstan roller 74 and the capstan roller 78.

During that time, the thermal head 20 is positioned away from the platen roller 21 (see FIG. 3) and the thermal transfer sheet R is fed a determined distance to the printing position Sr, for example at the starting edge of Y (yellow). Such control enables detecting the trailing edge of the Bk (black) portion of the thermal transfer sheet R by the light emitting sensor S4, and detection of the rotation of the clock plate, not shown in the drawings, disposed near the paired take-up rollers 57 by the unitized transmissive sensor, not shown in the drawings, to detect the distance from the trailing edge of the Bk (black) portion having a predetermined width on the thermal transfer sheet R, to the Y (yellow) portion on the thermal transfer sheet R.

The pinch rollers 38 and 39 on the first turning portion 6 stop rotating at the point where the unitized transmissive sensor, not shown in the drawings, arranged between the first turning portion 6 and the image forming portion 9, detects the trailing edge of the card C. The card C, inserted into the image forming portion 9, is transported in the direction of the arrow U, shown in FIG. 3, by the first turning portion 6, capstan roller 78 and the pinch roller 79 over the first card transport path P1. The CPU transports the card C in the direction of the arrow U for the number of pulses to the printing starting position, after the unitized sensor arranged between the capstan roller 78 and the thermal head 20 detects the leading edge of the card C, to transport the card C to the printing position, then starts the rotation of the thermal head sliding cam 23. At this point, the back surface of the card C is supported by the platen roller 21 by the rotating action of the thermal head sliding cam 23 toward the direction of the arrow A in FIG. 3. The front surface of the card C is pressed against the thermal head 20 interposed therebetween by the thermal transfer sheet R.

The CPU converts image data for YMC according to the predetermined image information into heat energy, adds a fixed coefficient according to the type of card C and intermediate transfer sheet F and sends that heating information to the thermal head 20. The elements of the thermal head 20 are heated according to this heating information. The pulse motor M1 drive rotates the platen roller 21 in the counterclockwise direction. In synchronization to that, the thermal transfer sheet R is taken-up by the thermal transfer sheet take-up portion 15 and the Y (yellow) image is formed (printed) by direct transfer to the card C.

The CPU rotates the thermal head sliding cam 23 further in the direction opposite to the arrow A in FIG. 3 when the forming of the image by the Y (yellow) portion is completed and the thermal head 20 is retracted from the card. The pulse motor Ml starts reverse drive after the thermal head 20 is retracted. This reverse rotates the platen roller 21, the capstan roller 74, the pinch roller 75, the capstan roller 78 and the pinch roller 79 and the card C is transported in the direction of the arrow D in FIG. 3. The CPU stops the reverse rotational drive of the pulse motor Ml after the leading edge of the card C passes the unitized transmissive sensor, not shown in the drawings, arranged between the capstan roller 78 and the thermal head 20, and the card C has been transported for a determined number of pulses. The CPU forward drives the pulse motor Ml to print the next die M (magenta). After the leading edge of the card C is detected by the unitized transmissive sensor, not shown in the drawings, arranged between the capstan roller 78 and the thermal head 20, the CPU transports the card C in the direction of the arrow U for a determined number of pulses to the print starting position. During that time, the CPU feeds a minute amount of the thermal transfer sheet R until the leading edge of the next color M (magenta) is positioned at the print starting position Sr. Then, by rotating the thermal head sliding cam 23 further in the direction of the arrow A, the thermal head 20 is pressed against the card C, therebetween interposed by the thermal transfer sheet R. The thermal head 20 forms the image of M (magenta) overlaying the previous color of Y (yellow) on the card C. The CPU repeats the aforementioned processes in order to overlap images in the YMC inks on the surface of the card C.

The CPU rotates the thermal head sliding cam 23 further in the direction opposite to the arrow A in FIG. 3 when the forming of the image onto the card C surface is completed and the thermal head 20 is retracted from the card. The CPU starts reverse drive of the pulse motor M1 after rotatingly driving the pinch rollers 38 and 39 after the thermal head 20 is retracted, and the card C is transported in the direction of the arrow D in FIG. 3, by the reverse rotation of the platen roller 21, the capstan roller 74, the pinch roller 75, the capstan roller 78 and the pinch roller 79. With the card C nipped by the first turning portion 6, the reverse rotational drive of the pulse motor M1 and the interlocking of the solenoid clutch 67 are stopped and the pinch rollers 38 and 39 rotational-drive are stopped (the state in FIG. 3).

Next, the CPU inverts both the first turning portion 6 and the second turning portion 5 (180° rotation). The card C, through this inversion is then inverted front to back with regard to the first card transport path P1. The CPU forms images on the back side of the card C using the aforementioned method. Note that printing to the back side of the card C often uses the one color of Bk (black). In such cases, images are formed using only Bk (black) according to the same method described above, and image forming using YMC is not performed. The CPU inverts both the first turning portion 6 and the second turning portion 5 (90° rotation) while the card C is nipped and the pinch rollers 38 and 39 on the first turning portion 6 are stopped after the image forming process on the back side of the card C is completed. (See FIG. 6.) This positions the card C on the second card transport path P2. Processing using the hologram can now be started.

The CPU rotatingly drives the pinch rollers 38 and 39 on the first turning portion 6, the paired horizontal transport rollers 11, the paired transport rollers 48 and the plurality of paired rollers on the horizontal transport portion 12 to transport the card C in the direction of the arrow L in FIG. 6 over the second card transport path P2. The CPU stops the rotation of the pinch rollers 38 and 39 when the trailing edge of the card C is detected by the unitized sensor, not shown in the drawings, arranged between the first turning portion 6 and the horizontal transport portion 12. By transporting the card C for a determined number of pulses from the unitized transmissive sensor, not shown in the drawings, to the heat roller 45, the leading edge of the card C is positioned to touch the heat roller 45. Next, the heat roller elevator cam 51 is rotated in the direction of the arrow B. This shifts the heat roller 45 from being separated from the platen roller to a state in which it is touching the platen roller 50. Note that the heat lamp 46 inside the heat roller 45 is pre-lit to allow it to reach the determined transfer temperature.

At this point, the leading edge of the card C touches the heat roller 45, the back side of the card C being supported by the platen roller 50 and the hologram sheet H interposed between the card C and heat roller 45. The card C abuts the heat roller 45, the hologram sheet H interposed therebetween, and the back side of the card C being supported by the platen roller 50 that rotates in the counterclockwise direction. The card C is transported in the direction of the arrow L in FIG. 6. The peeling layer on the hologram sheet H is peeled away from the base film by the heat of the heating lamp 46 and the hologram layer and overcoat layer are transferred to the card C surface as a single body. In synchronization to the transfer of the hologram layer and the overcoat layer, the hologram sheet H is taken up by the hologram sheet take-up portion 30.

The CPU stops rotational drive to the pulse motor M2 feed direction when the transfer of the hologram sheet H to the front surface of the card C is completed according to the dimensions of the card C and re-rotates the heat roller elevator cam 51 to the direction of the arrow B to retract the heat roller 45 from the platen roller 50. The card C is discharged to the stacker 13 passing the horizontal transport portion 12 by way of the discharge outlet 27. The CPU stops the drive of the roller on the second card transport path P2 after a determined amount of time from when a signal is received from the unitized transmissive sensor, not shown in the drawings, arranged between the horizontal transport portion 12 and the discharge outlet 27 and displays the number of cards for which processing has been completed or that processing is completed on the touch panel.

(2) Operations for direct transfer to the back surface and indirect transfer to the front surface.

Firstly, the CPU, in the same way as direct printing to both surfaces of the card C, determines the existence of the intermediate transfer sheet F using the detection signals of light emitting sensors S2 and 56 and the detection signals of the sensors 58 and 59. If it is determined that it does not exist, the CPU displays a message to change the intermediate transfer sheet F on the touch panel and waits until the opening and closing door is opened and closed once. If it is positively determined that the intermediate transfer sheet F exists, after image forming to the card .C back surface using the direct transfer method as described above, the first turning portion 6 is rotated 90° (see the state shown in FIG. 4) along with the second turning portion 5 while the pinch rollers 38 and 39 on the first turning portion 6 are stopped with the card C nipped therebetween. Note that when forming images using both the direct transfer method and the indirect transfer method, the intermediate transfer sheet F is trained to the platen roller 21 and back-tension roller 88. The pulse motor Ml and the pulse motor M2 are rotatingly driven so that the direction of transport of the card C when forming images to the back side of the card C and the direction of transport of the intermediate transfer sheet F when forming images to the intermediate transfer sheet F are the same, but the transport speed of the intermediate transfer sheet F at the printing position Sr is greater than the transport speed of the card C. This is the same for the thermal transfer sheet R comprising an ink layer for forming images. The paired take-up rollers 57 and thermal transfer sheet take-up portion 15 are rotatingly driven so that the transport speed of the thermal transfer sheet R by the paired take-up rollers 57 and thermal transfer sheet take-up portion 15 that drives with the rotational drive of the paired take-up rollers 57 to take up the thermal transfer sheet R as the thermal transfer sheet R transport means is higher when, forming images to the intermediate transfer sheet F than when forming images to the card C. In this way, so that the transport speed of the thermal transfer sheet R differs, the rotating speed of the take-up spool shaft thereto mounted is the spool on the take-up side that rolls up the thermal transfer sheet R with the paired take-up rollers 57 is rotated differently to be greater when forming images on the intermediate transfer sheet F than when forming images to the card C. Note that as the drive source for the paired take-up rollers 57 and the take-up spool shaft a DC motor, not shown in the drawings in the present embodiment, is employed.

Next, the CPU heats the thermal transfer sheet H ink with the thermal head 20 and forms an image on the reception layer Fe on the intermediate transfer sheet F. When forming an image, the pulse motor Ml is rotated to rotate the platen roller 21 in the counterclockwise direction while the pulse motor M2 is rotated to take-up the intermediate transfer sheet F on the intermediate transfer sheet supply portion 16 and in synchronization to that, the thermal transfer sheet R is taken up on the thermal transfer sheet take-up portion 15. In other words, it recognizes a mark for positioning established on the intermediate transfer sheet F by monitoring the light emitting sensor S2. It monitors the rotating amount of the clock plate 90 connected to the back-tension roller 88 that always rotates forward and reverse as one unit to feed or back up the intermediate transfer sheet F to transport the intermediate transfer sheet F for a determined distance to the image print starting position. The thermal head 20 is positioned away from the platen roller 21 and as described above, the thermal transfer sheet R is fed for a determined distance to the printing position Sr, for example to the starting edge of Y (yellow). The CPU rotates the thermal head sliding cam 23 further in the direction opposite to the arrow A in FIG. 4 when the starting edge of the Y (yellow) portion has reached the printing position Sr and touches the thermal head 20 to the platen roller 21 with the thermal transfer sheet R interposed therebetween. Simultaneously, the pulse motor Ml and the pulse motor M2 back up to rotate, in the (Rv) direction. This forms the image using the color Y (yellow) on the intermediate transfer sheet F.

The CPU rotates the thermal head sliding cam 23 when the forming of the image on the Y (yellow) portion is completed to the intermediate transfer sheet F, to retract the thermal head 20 from the platen roller 21. By rotating the pulse motor Ml and the pulse motor M2 in the feeding direction (Fw), the take-up spool shaft 110 rotates in the counterclockwise direction and takes up the intermediate transfer sheet F until the positioning mark established thereupon passes the light emitting sensor S2. Next, in the same way as for the Y (yellow) portion, it recognizes a mark for positioning established on the intermediate transfer sheet F by monitoring the light emitting sensor S2. It monitors the rotating amount of the clock plate 90 connected to the back-tension roller 88 that always rotates forward and reverse as one unit to feed or back up the intermediate transfer sheet F to transport the intermediate transfer sheet F for a determined distance to the image print starting position. The thermal transfer sheet R is fed minutely until the leading edge of the M (magenta) portion reaches the printing position Sr. In the same manner as was used for the Y (yellow) portion, the thermal head sliding cam 23 rotates again to touch the thermal head 20 to form an image of the M (magenta) portion onto the Y (yellow) portion on the receptive layer FE on the thermal transfer sheet R. The CPU repeats the above described processes in order to form images in layers using the YMC inks on the intermediate transfer sheet F, and then retracts the thermal head 20 from the platen roller 21.

Note that through the control portion 19 thermal control unit, the thermal energy applied to the thermal head 20 when forming images on the intermediate transfer sheet F when forming images thereupon is lower than the thermal energy applied to the thermal head 20 when directly transferring to the card C (it is larger when directly transferring to the card C) due to the difference in the characteristics of the intermediate transfer sheet F and the card C, such as their thermal capacity. Operations of such thermal energy can be performed by changing coefficients to the aforementioned thermal energy.

Next, the CPU rotates the pulse motors M1 and M2 in the feeding direction (Fw) to transport the intermediate transfer sheet F to the heat roller 45 separated from the platen roller 50 in advance, according to the amount of rotation of the clock plate 90 detected by the unitized transmissive sensor S7. Note that by monitoring the light emitting sensor S6 during the transport, it is possible to detect the mark for positioning the intermediate transfer sheet F making it possible to reset the amount of transport at this point to improve the accuracy of the transport. At this time, in the same way as just described for direct transfer to both sides, the CPU rotatingly drives the pinch rollers 38 and 39 on the first turning portion 6, the paired horizontal transport rollers 11, the paired transport rollers 48 and the plurality of paired rollers on the horizontal transport portion 12 to transport the card C in the direction of the arrow L in FIG. 4 over the second card transport path P2.

The CPU rotates the heat roller elevator cam 51 in the direction of the arrow when the leading edge of the card C reaches the position that touches the heat roller 45 and shifts the heat roller 45 from being separated from the platen roller 50 to touching the platen roller 50, then stops the rotation of the heat roller elevator cam 51. At this point, the leading edge of the card C touches the heat roller 45, the back side of the card C being supported by the platen roller 50 and the intermediate transfer sheet F interposed between the card C and heat roller 45. The CPU rotatingly drives the pulse motor M2 in the feeding direction (Fw.) The card C abuts the heat roller 45, the intermediate transfer sheet F interposed therebetween, and the back side of the card C being supported by the platen roller 50 that rotates in the counterclockwise direction. The card C is transported in the direction of the arrow L in FIG. 4. The peeling layer Fc on the intermediate transfer sheet F is peeled away from the base film Fa by the heat of the heating lamp 46 and the layer Fe formed thereupon with an image and the overcoat layer are transferred to the card C surface as a single body. In synchronization to this transfer, the intermediate transfer sheet F is taken up by the intermediate transfer sheet take-up portion 17.

The CPU stops the rotational drive to the feeding direction of the pulse motor Ml and the pulse motor M2 when the transfer of the intermediate transfer sheet F to the front surface of the card C is completed according to the dimensions of the card C and re-rotates the heat roller elevator cam 51 to retract the heat roller 45 from the platen roller 50. The card C is discharged to the stacker 13 passing the horizontal transport portion 12 by way of the discharge outlet 27.

The following shall describe the actions of the printing apparatus 1 according to this embodiment.

The printing apparatus 1 according to the present embodiment comprises a transfer portion 10 to transfer to the card C images formed on an image forming portion 9 that in turns forms images on the card C or to the intermediate transfer sheet F and on the intermediate transfer sheet F so it is possible to switch between the direct transfer and indirect transfer methods of printing. Furthermore, the printing apparatus 1 can cover the card C formed thereupon by images of the direct transfer method with the hologram sheet H using the transfer portion 10. For that reason, the operator switch between either the direct transfer method and the indirect transfer method to print according to the material quality of the card C, such as it being either a PVC or a PET type card, whether or not it is embossed, the surface shape and characteristics of the card C including the presence of IC elements, and information and a variety of purposes relating to various types of printing such as whether or not printing is to occur over the entire surface of the card C to enable the operator to reduce the running costs associated with printing to the card C.

Still further, with the printing apparatus 1, the forming of images to the card C and to the intermediate transfer sheet F is performed with the single thermal head 20 and along with the single thermal transfer sheet R, the transfer from the intermediate transfer sheet F and the hologram sheet H to the card C is performed with the single heat roller 45. Also, the platen roller 50 opposingly arranged to the platen roller 21 which is opposingly arranged to the thermal head 20, and to the heat roller 45 is commonly used to transfer the intermediate transfer sheet F or the hologram sheet H to the card when an image is formed on the card C or the intermediate transfer sheet F. Therefore, with the printing apparatus 1, there is sharing of the direct transfer method and the indirect transfer method and the overcoat to lower costs without increasing the size of the printing apparatus 1.

Also, with the printing apparatus 1, equipped to commonly use the supply spool shaft 120 for the intermediate transfer sheet supply portion 16 that supplies the intermediate transfer sheet F and the hologram sheet supply portion 29 that supplies the hologram sheet H, and to commonly use the take-up spool shaft 110 for the intermediate transfer sheet take-up portion 17 that takes up the intermediate transfer sheet F and the hologram sheet take-up portion 30 that takes up the hologram sheet H so it is possible to commonly use the supply mechanism for the intermediate transfer sheet F and hologram sheet H and the take-up mechanism for the intermediate transfer sheet F and the hologram sheet H which allows a more compact printing apparatus 1 that eliminates duplication of these mechanisms.

Still further, with the printing apparatus 1, by rotating the take-up spool shaft 110 and the supply spool shaft 120 with the pulse motor M2, it is possible to simplify the drive mechanisms thereby further enhancing the compact nature of the printing apparatus 1. The pulse motor M1 transports the intermediate transfer sheet F over the transport path of the intermediate transfer sheet F while transporting the card C. The solenoid clutch 67 prevents looseness of the intermediate transfer sheet F so while it is possible to form images in layers using the three colors of YMC to the intermediate transfer sheet F, it is unnecessary to create a separate transport drive portion near the image forming portion 9 of the card C. Therefore, the cost of the printing apparatus 1 is still further reduced. Moreover, both of the pulse motors M1 and M2 can be driven in forward and in reverse. Because the unitized transmissive sensor S7 detects the rotation amount to detect the amount that the intermediate transfer sheet F in the intermediate transport path for the intermediate transfer sheet F has been fed or rewound, printing of the three colors of YMC can be overlapped without any discrepancy in color layers.

Furthermore, in the printing apparatus 1, the thermal head control unit in the control portion 19 controls for more thermal energy to be applied to the thermal transfer sheet R by the thermal head 20 when forming an image on the card C than that to be applied to the thermal transfer sheet R by the thermal head 20 when forming an image on the intermediate transfer sheet F. The control unit 19 actuator control unit increases the transport speed of the intermediate transfer sheet F when forming images thereto with the drive mechanism illustrated in FIG. 5 so that it has a faster transport speed than the transport speed of the thermal transfer sheet R when forming an image to the card C by the thermal head 20, 50 it is possible to attain high quality images without a decrease in the printing performance, regardless of the differences in characteristics of the card C and the intermediate transfer sheet F such as their thermal capacity.

In the printing apparatus 1, the pulse motor M1 and pulse motor M2 are rotatingly driven so that the direction of transport of the card C when forming an image to the back side thereof and the direction of transport of the intermediate transfer sheet F when forming an image thereto are the same so the capstan rollers 74 and 78 that transport the card C near the image forming portion 9 can be compactly arranged near the platen roller 50 further enabling a more compact image forming portion 9.

Again in the printing apparatus 1, the image forming portion 9 is arranged in a position intersecting the first card transport path P1 and the transfer portion 10 is arranged in a position intersecting the second card transport path P2 so the printing apparatus 1 does not have an elongated body but has a freedom of design while enabling it to be more compact.

Still further, in the printing apparatus 1, at the intersecting point X1 of the first card transport path P1 and the second card transport path P2 the first turning portion 6 that rotates or inverts the card C is arranged. At the intersecting point X2 of the first card transport path P1 and the third card transport path P3 the second turning portion 5 that rotates or inverts the card C is arranged. Thus, it is possible to switch the transport direction of the card C using these turning portions thereby enabling the transport path of the card C to fit into the compact space of the entire printing apparatus 1.

The first turning portion 6 sends the card C to the first card transport path P1 and the second card transport path P2, the first card transport path Pi and the second card transport path P2 accepting the card C therebetween while the second turning portion 5 accepts it therebetween the information recording portion 8 that records information onto the card C. The first turning portion 6 and second turning portion 5 are connected in the vertical direction so the recording medium can be transported in a compact space without any decrease in transport performance. Because the image forming portion 9 is disposed above the first turning portion 6, to a side is disposed the transfer portion 10 and below the transfer portion 10 is disposed the information recording portion 8, it is possible to rationally arrange the configuring members of the printing apparatus 1.

Furthermore, the printing apparatus 1 is equipped with the discharge outlet 27 at the final end portion of the second card transport path P2 so after transferring the intermediate transfer sheet F or the hologram sheet H to the card C at the transfer portion 10, the card C can be discharged as is, thus enabling a shorter transport path of the printing apparatus 1. The present invention disposes the eject outlet 28 for ejecting the card C having been detected to have erroneous writing by the information recording portion 8. The second turning portion 5 rotates the card C detected to be erroneously written and ejects them from the printing apparatus via the eject outlet 28 so no transport path for transporting the card C detected to be erroneously written by the information recording portion 8 is necessary, further enabling the printing apparatus 1 to become more compact.

Note that the printing apparatus 1 according to the present embodiment discloses a magnetic encoder for recording on the information recording portion 8 and a contact type IC writer/reader device but it is also perfectly conceivable to employ a non-contact type antenna to electrically read and write to an IC chip embedded in the card, if the target for recording is a non-contact type IC card. To selectively perform magnetic recording and electrical recording, it is acceptable to arrange an IC writer, etc., between the second turning portion 5 and the eject outlet 28 and to arrange another turning portion between the second turning portion 5 and the information recording portion 8 to arrange two types of information recording portions at 90° angles. It is important to note that normally to write information with a magnetic encoder requires one or a plurality of reciprocal transports to the information writing/reading head to magnetically write the data and to verify its correctness, but the transport of the card can be handled by the rotation or the reverse drive of a plurality of transport rollers in the information recording portion.

Furthermore, according to this embodiment of the invention, the first turning portion 6 and the second turning portion 5 are synchronized (interlocked) to rotate or invert, but these turning portions can also be independently rotated or inverted. Still further, according to this embodiment of the present invention, the rotating frame 40 and the pinch rollers 38 and 39 are independently driven. However, to prevent any offset of the card, it is perfectly acceptable to rotate the pinch rollers 38 and 39 in reverse for the same amount of angle as the rotating frame 40.

Again, according to this embodiment of the present invention, the first card transport path 21 is formed substantially vertically where the image forming portion 9 is arranged, and the second card transport path P2 is formed substantially horizontally where the transfer portion 10 is arranged, but it is also conceivable to form the first card transport path P1 substantially horizontally and the second card transport path 22 substantially vertically. In such a situation, the arrangement of the first turning portion 6 and the second turning portion 5.can be slightly altered so that the image forming portion 9 and transfer portion 10 are separated by 90° so the printing apparatus is able to attain the same effect as the present embodiment.

Still further, the present embodiment teaches covering the card C with a hologram sheet H, but it is also acceptable to use only a simple coating film to cover the card C that has not hologram instead the hologram sheet H. Using the hologram sheet H to cover the surface of the card C enhances the security of the card C but a similar protection as the hologram sheet H can be attained with a coating film having a receptive layer formed directly on the card C.

Furthermore, this embodiment of the present invention teaches manually replacing the intermediate transfer sheet F and the hologram sheet H, to simplify the explanation, but again it is also perfectly acceptable to employ well known technology to electrical switch them on the same shaft. In this case, it is acceptable to arrange onto each of the take-up spool shaft 110 and the supply spool shaft 120 the intermediate transfer sheet take-up portion 17 and the hologram sheet take-up portion 30 and the intermediate transfer sheet supply portion 16 and hologram sheet supply portion 29, to arrange only onto the same shaft of the take-up spool shaft 110 the intermediate transfer sheet take-up portion 17 and the hologram sheet take-up portion 30 and to mount the intermediate transfer sheet supply portion 16 and the hologram sheet supply portion 29 on separate spool shafts, or conversely, to arrange only the intermediate transfer sheet supply portion 16 and the hologram sheet supply portion 29 on the same shaft as the supply spool shaft 120 and to mount the intermediate transfer sheet take-up portion 17 and the hologram sheet take-up portion 30 on separate spool shafts.

Again, in the present embodiment of the invention, it is taught to position the card C using a unitized transmissive sensor to form images by layering three colors, when directly transferring to both surfaces of a card medium but as described for the indirect transfer method, it is also perfectly acceptable to dispose a clock plate on the capstan roller 78, for example, and use a unitized transmissive sensor to detect the rotation amount of the clock plate.

Again, according to the present embodiment of the invention, it is taught to print to the front side of the card C first, when using the direct transfer method to print to both sides of the card C, but it is also possible to print to the back side first. In the two operations described above for the present embodiment, no mention was made to an example to not overcoat with the intermediate transfer sheet F and the hologram sheet H, but it is acceptable to not employ the thermal process at the transfer portion 10 and to discharge the card C as it is as a card C with no overcoat. Still further in the present embodiment of the invention, it is disclosed that the paired rollers on the second card transport path P2 rotate only in the direction of the arrow L in FIG. 1, but if it is made possible to transport in the direction of the arrow R, after directly printing to the front surface side of the card C, that surface can be covered with the hologram sheet H and reversed to the direction of the arrow R to be directly printed on the back side thereof and subsequently discharged In the same way, when directly and indirectly transferring images, the indirect transfer occurs after the aforementioned operations, but it is also acceptable to perform the indirect transfer first to be followed by the direct transfer.

Figure 8:
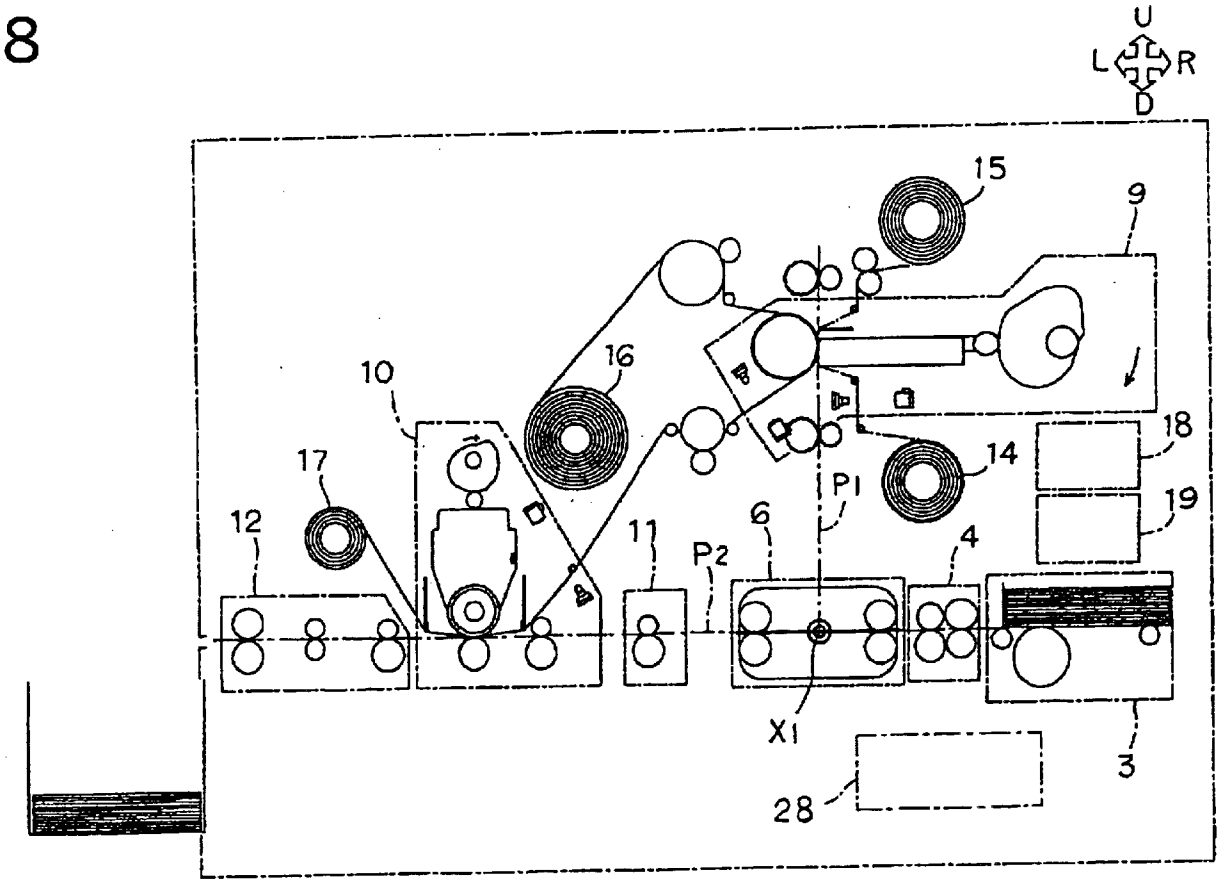
FIG. 8 is a side view showing the general configuration of another embodiment of the printing apparatus applying the present invention.

Also disclosed in this embodiment of the present invention is an information recording portion 8 built-in to the printing apparatus 1. However, as clearly suggested by FIG. 8, if it is supposed that the information recording to the card C is performed outside of the printing apparatus 1, or cards do not require such recording, it would not be necessary to dispose the second turning portion 5 and the information recording portion 8 inside of the printing apparatus 1 if the cleaner 4 is disposed upstream of the first turning portion 6 and the card supply portion 3 even further upstream, so while making it possible to have such an arrangement as an option for the printing apparatus 1, it would also help to reduce the size of the printing apparatus by excluding the second turning portion 5 and the information recording portion 8.

As described above, the present invention transfers directly to a recording medium with the first printing means and transfers indirectly to a recording medium with the second printing means and the transfer means. Therefore, while being possible to print to a recording medium by switching between a direct transfer method and an indirect transfer method the first printing means and the second printing means are arranged in the same position thereby enabling a more compact printing apparatus.

Also as described above, the present invention transfers directly to a recording medium with at least one of the printing means and covers the surface of a recording medium with an over-coating means. The transfer means can transfer indirectly to a recording medium. Therefore, while being possible to print by switching between a direct transfer method and an indirect transfer method the over-coating means and the transfer means are arranged in the same position thereby enabling a more compact printing apparatus.

What is claimed is:

1. A printing apparatus comprising:

at least one printing means for selectively forming an image on a recording medium and an intermediate transfer medium that temporarily retains the image;

over-coating means for covering a surface of the recording medium formed thereupon with the image with a coating film; and transfer means for transferring the image on the intermediate transfer medium to the recording medium, said over-coating means and said transfer means being integrated together and formed by a single heating element.

2. A printing apparatus according to claim 1, wherein said heating element is a heat roller having an exothermic body.

3. A printing apparatus according to claim 1, further comprising a supply spool shaft that is capable of mounting a first supply spool for supplying the intermediate transfer medium and a second supply spool for supplying the coating film, and a take-up spool shaft that is capable of mounting a first take-up spool for taking up the intermediate transfer medium and a second take-up spool for taking up the coating film, at least one of said supply spool shaft and said take-up spool shaft being a single spool shaft.

4. A printing apparatus according to claim 1, further comprising a platen opposingly arranged to the heating element for supporting the recording medium when the over-coating means covers the surface of the recording medium with the coating film and when the transfer means transfers the image.

5. A printing apparatus according to claim 3, further comprising first drive means for rotatingly driving the take-up spool shaft, said first drive means rotatingly driving at least one of the first supply spool and the second supply spool.

6. A printing apparatus according to claim 5, wherein said first drive means is a motor capable of rotating both forward and in reverse.

7. A printing apparatus according to claim 5, further comprising intermediate transfer medium transport means disposed in an intermediate transfer medium transport path between the first supply spool and the first take-up spool for transporting the intermediate transfer medium, and second drive means for rotatingly driving the intermediate transfer medium transport means.

8. A printing apparatus according to claim 7, further comprising measuring means disposed in the intermediate transfer medium transport path for measuring feeding and returning amounts of the intermediate transfer medium.

9. A printing apparatus according to claim 7, wherein said second drive means is a motor capable of rotating both forward and in reverse.

* * * * *